US011248602B2

(12) United States Patent
Pippes

(10) Patent No.: US 11,248,602 B2
(45) Date of Patent: Feb. 15, 2022

(54) FLUID DELIVERY DEVICE WITH A FOREPUMP, A MAIN PUMP, AND BYPASS LINE WITH A CHECK VALVE

(71) Applicant: ECKERLE TECHNOLOGIES GMBH, Malsch (DE)

(72) Inventor: Reinhard Pippes, Bretten-Sprantal (DE)

(73) Assignee: ECKERLE TECHNOLOGIES GMBH, Malsch (DE)

( * ) Notice: Subject to any disclaimer, the term of this patent is extended or adjusted under 35 U.S.C. 154(b) by 0 days.

(21) Appl. No.: 16/955,492

(22) PCT Filed: Dec. 13, 2018

(86) PCT No.: PCT/EP2018/084721
§ 371 (c)(1),
(2) Date: Jun. 18, 2020

(87) PCT Pub. No.: WO2019/121307
PCT Pub. Date: Jun. 27, 2019

(65) Prior Publication Data

US 2020/0318635 A1 Oct. 8, 2020

(30) Foreign Application Priority Data

Dec. 22, 2017 (DE) ..... 10 2017 223 675.2

(51) Int. Cl.
*F04C 11/00* (2006.01)
*F04C 2/10* (2006.01)
(Continued)

(52) U.S. Cl.
CPC ..... *F04C 11/001* (2013.01); *F04C 2/101* (2013.01); *F04C 2/18* (2013.01); *F04C 11/005* (2013.01); *F04C 14/26* (2013.01); *F04C 2240/60* (2013.01)

(58) Field of Classification Search
CPC .... F04C 11/001; F04C 14/26; F04C 2240/30; F04C 2240/60; F04C 2/101; F04C 2/18; F04C 11/005
See application file for complete search history.

(56) References Cited

U.S. PATENT DOCUMENTS 5,820,354 A * 10/1998 Wild ..... F04C 11/001 417/244
6,679,692 B1 * 1/2004 Feuling ..... F04C 11/001 418/171
(Continued)

FOREIGN PATENT DOCUMENTS

DE 4439545 A1 5/1996
DE 102007032103 A1 11/2008
(Continued)

OTHER PUBLICATIONS

International Search Report (in English and German) and Written Opinion of the ISA (in German) issued in PCT/EP2018/084721; ISA/EP.
(Continued)

*Primary Examiner* — Mary Davis
(74) *Attorney, Agent, or Firm* — Harness, Dickey & Pierce, P.L.C.; Stephen T. Olson

(57) ABSTRACT

A fluid delivery device having a forepump and a main pump fluidically connected to the forepump, wherein the forepump can be driven via a forepump input shaft and the main pump can be driven via a main pump input shaft. According to the invention, the forepump has a forepump drive gear coupled to the forepump input shaft and a forepump delivery gear interacting with the forepump drive gear to deliver the fluid, wherein the forepump and the main pump are drivingly coupled to a common drive shaft, and wherein the forepump delivery gear and the main pump input shaft are connected to one another via a connecting shaft such that the forepump
(Continued)

Figure 1:
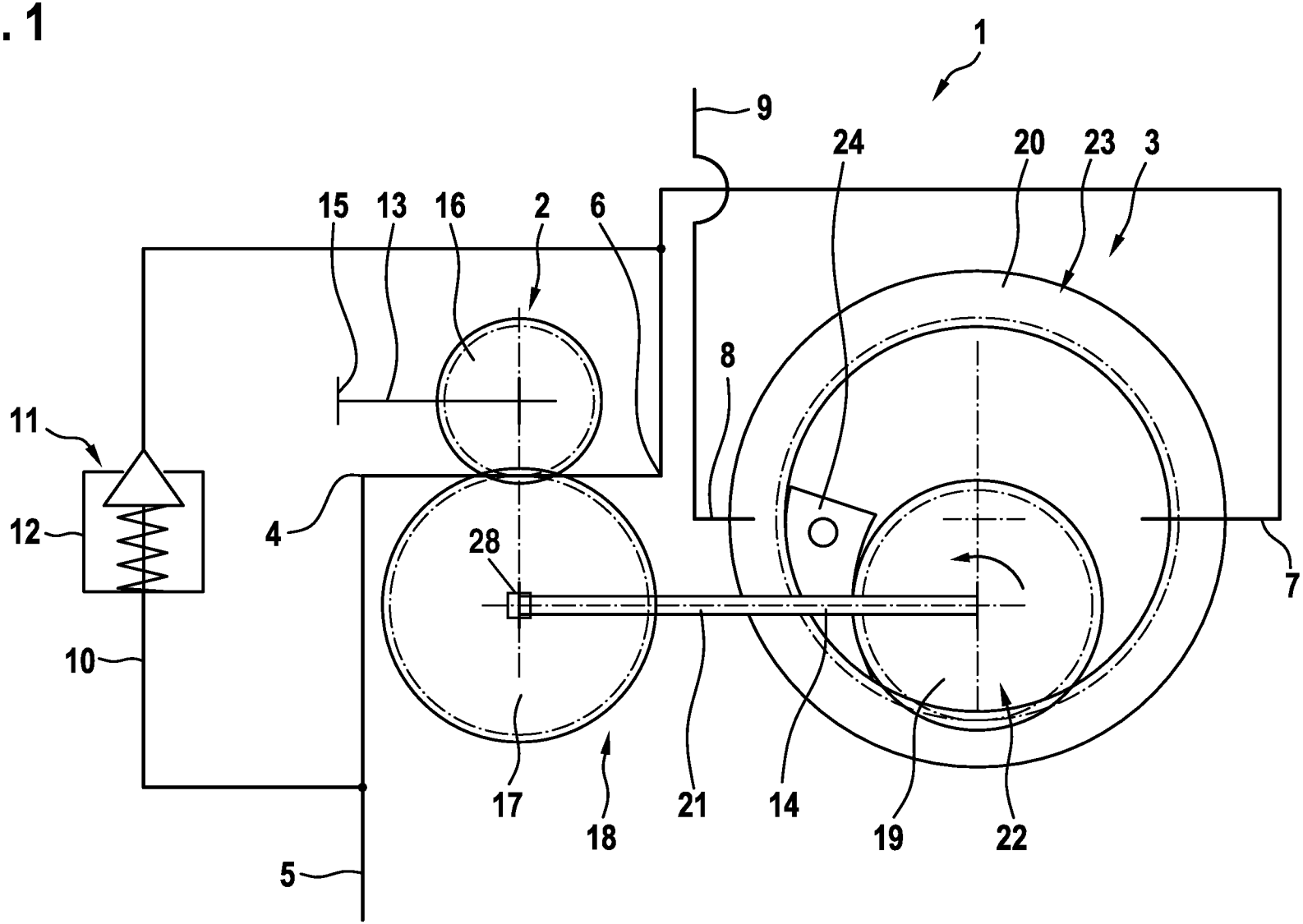

input shaft is coupled directly to the drive shaft and the main pump input shaft is coupled to the drive shaft via the connecting shaft.

8 Claims, 3 Drawing Sheets

(51) Int. Cl.
*F04C 2/18* (2006.01)
*F04C 14/26* (2006.01)

(56) References Cited

U.S. PATENT DOCUMENTS

| | | | |
|---|---|---|---|
| 7,290,995 | B2 | 11/2007 | Ohnishi et al. |
| 8,231,359 | B2 | 7/2012 | Merz et al. |
| 9,353,743 | B2 | 5/2016 | Ehrhardt et al. |
| 2010/0119383 | A1 | 5/2010 | Merz et al. |
| 2014/0178230 | A1 | 6/2014 | Ehrhardt et al. |
| 2015/0377235 | A1 | 12/2015 | Vertenoeuil |

FOREIGN PATENT DOCUMENTS

| | | | |
|---|---|---|---|
| DE | 102012210925 | A1 | 5/2014 |
| DE | 102013223860 | A1 | 5/2015 |
| DE | 102012112720 | B4 | 1/2017 |
| FR | 2992693 | A1 | 1/2014 |
| JP | 61175366 | A | 8/1986 |
| JP | S61175366 | A | 8/1986 |
| JP | 2000045961 | A | 2/2000 |
| WO | WO-2008031012 | A2 | 3/2008 |
| WO | WO-2011076172 | A2 | 6/2011 |

OTHER PUBLICATIONS

International Preliminary Report on Patentability, dated Sep. 26, 2019.

International Preliminary Report on Patentabiliy received for the International Application No. PCT/EP2018/084721, dated Jun. 25, 2020, 7 pages.

* cited by examiner

FLUID DELIVERY DEVICE WITH A FOREPUMP, A MAIN PUMP, AND BYPASS LINE WITH A CHECK VALVE

CROSS-REFERENCE TO RELATED APPLICATIONS

This application is a 371 U.S. National Phase of International Application No. PCT/EP2018/084721, filed Dec. 13, 2018, which claims the benefit of German Patent Application No. 10 2017 223 675.2, filed Dec. 22, 2017. The entire disclosures of the above applications are incorporated herein by reference.

The invention relates to a fluid delivery device having a forepump and a main pump fluidically connected to the forepump, wherein the forepump can be driven via a forepump input shaft and the main pump can be driven via a main pump input shaft.

For example, DE 10 2007 032 103 A1 is known from the prior art. This relates to a pump unit having a main pump and a charge pump whose delivery volume can be adjusted. A stroke ring is provided to adjust the delivery volume of the charge pump. The stroke ring is loaded with an actuating force that depends on the input pressure of the main pump.

It is an object of the invention to propose a fluid delivery device which has advantages over known fluid delivery devices, in particular an ideal coordination of the forepump and the main pump and consequently a long service life of the fluid delivery device, especially the main pump.

"According to the invention, the forepump has a forepump drive gear coupled to the forepump input shaft and a forepump delivery gear interacting with the forepump drive gear to deliver the fluid, wherein the forepump and the main pump are drivingly coupled to a common drive shaft, and wherein the forepump delivery gear and the main pump input shaft are connected to one another via a connecting shaft such that the forepump input shaft is coupled directly to the drive shaft and the main pump input shaft is coupled to the drive shaft via the connecting shaft".

The fluid delivery device serves to deliver a fluid, for example a liquid or a gas. For this purpose, the fluid delivery device has the forepump and the main pump, wherein the main pump is fluidically connected to the forepump. This means that the fluid is first fed to the forepump, which delivers the fluid in the direction of the main pump. The fluid delivered by the forepump is thus made available to the main pump which delivers the fluid further, namely, for example, in the direction of a fluid outlet of the fluid delivery device, which can also be referred to as the delivery device fluid outlet.

Each of the pumps has an input shaft via which it can be driven, namely the forepump via the forepump input shaft and the main pump via the main pump input shaft. The forepump also has two gears to deliver the fluid, namely the forepump drive gear and the forepump delivery gear. The forepump drive gear and the forepump delivery gear are provided for fluid delivery and for this reason are designed in such a way that, when the forepump input shaft rotates, they cooperate to deliver the fluid and, for example, engage with one another.

The forepump drive gear is coupled to the forepump input shaft, preferably in a fixed and/or permanent manner. The forepump drive gear is preferably arranged on the forepump input shaft so that it always has the same speed as the forepump input shaft during operation of the forepump. The forepump input shaft is drivingly coupled to the common drive shaft, preferably again in a fixed and/or permanent manner. For example, the forepump input shaft and the common drive shaft are configured in one piece, so that the forepump input shaft is formed by the drive shaft and/or vice versa. In this respect, the forepump can be driven directly and immediately via the drive shaft.

The main pump, on the other hand, should only be drivable indirectly via the drive shaft. For this purpose, the main pump is drivingly connected to the drive shaft via the forepump, so that when the drive shaft rotates, the main pump is driven by the forepump. For this purpose, the forepump drive gear and the forepump delivery gear are drivingly connected to one another. This is to be understood to mean that the forepump drive gear is provided and designed to drive the forepump delivery gear, so that when the forepump input shaft rotates, both the forepump drive gear and the forepump delivery gear rotate.

The forepump delivery gear is now drivingly connected to the main pump input shaft, namely via the connecting shaft. In other words, the main pump is drivingly connected to the forepump delivery gear, so that when the forepump delivery gear rotates, there is preferably also a turning movement of the main pump input shaft. The main pump input shaft and the connecting shaft can be configured separately or in one piece with one another. In the latter case, the main pump input shaft forms the connecting shaft and/or vice versa. For example, the forepump delivery gear is rotatably supported by means of the connecting shaft and/or the main pump input shaft.

In other words, the fluid delivery device is designed such that the forepump input shaft is directly and immediately coupled to the drive shaft. The main pump input shaft, however, is only indirectly coupled to the drive shaft via the connecting shaft and/or the forepump. Such an embodiment of the fluid delivery device has the advantage that the rotational speed of the forepump and the main pump or the respective input shaft are in a fixed relationship with one another, so that, for example, there is a certain relationship between the rotational speeds. As a result, very good coordination between the forepump and the main pump is achieved during the operation of the fluid delivery device.

A further embodiment of the invention provides that the forepump drive gear and the forepump delivery gear form a transmission gear for the main pump with a specific transmission ratio. In other words, the specific transmission ratio is between the forepump drive gear and the forepump delivery gear and therefore also between the forepump input shaft and/or the drive shaft on the one hand and the connecting shaft and/or the main pump input shaft on the other hand.

The transmission ratio is preferably different from one, so that due to the transmission gear during operation of the fluid delivery device, the forepump gear has a rotational speed which is different from a rotational speed of the forepump drive gear, or there is a specific speed ratio between the speed of the forepump delivery gear and the speed of the forepump drive gear which corresponds to the transmission ratio.

The speed of the drive shaft for the main pump is adjusted using the forepump. As a result, an optimum speed can be achieved both for the forepump and for the main pump, without having to provide an additional gear via which the forepump input shaft and the main pump input shaft are connected to one another. In other words, a particularly compact configuration of the fluid delivery device is realized by driving the main pump via the forepump.

In a further embodiment of the invention it is provided that the forepump is designed as a gear pump and/or the main pump is designed as a rotary piston pump. The configuration of the forepump as a gear pump allows for a particularly advantageous and reliable use of the forepump as a transmission gear. The gear pump is understood to mean, for example, an external gear pump or an internal gear pump. The forepump or the gear pump is particularly preferably gap-compensated. If the forepump is in the form of the gear pump, the forepump drive gear can be referred to as forepump drive gear wheel and the forepump delivery gear can be referred to as forepump delivery gear wheel and are present as gears according to their designation. The interaction of the gears to deliver the fluid takes place through an engagement with one another or a meshing with one another. In other words, the forepump drive gear meshes with the forepump delivery gear to deliver the fluid, wherein the transmission gear is formed at the same time. A toothing of the forepump drive gear and a toothing of the forepump delivery gear are preferably designed as helical teeth. In this way, noise generated by the forepump can be significantly reduced in comparison to straight teeth. Of course, however, the teeth can alternatively also be designed as straight teeth.

Additionally or alternatively, the main pump is a rotary piston pump. The rotary piston pump is understood to mean, for example, a rotary lobe pump, a rotary vane pump, a rotary piston pump or a gear pump. The gear pump can in turn be designed as an external gear pump and as an internal gear pump. The main pump is also particularly preferably designed to be gap-compensated, namely in particular in the case of its design as a gear pump. The main pump is particularly preferably designed as a gear pump, that is to say, for example, as an external gear pump or as an internal gear pump, the latter being the case in the scope of a particularly preferred embodiment of the fluid delivery device. Particularly excellent properties of the fluid delivery device result in the case of the configuration of the forepump and the main pump as gear pumps, so that both pumps are each available as gear pumps. For example, the forepump is designed as an external gear pump and the main pump is designed as an internal gear pump. This provides a particularly reliable provision of the fluid for the main pump by the forepump.

A particularly preferred embodiment of the invention provides that the forepump has a larger delivery volume than the main pump. The delivery volume can also be referred to as displacement volume. For example, the delivery volume of the forepump is at least 5%, at least 10%, at least 15%, at least 20% or at least 25% larger than the delivery volume of the main pump. Such a configuration of the fluid delivery device ensures that the main pump is always provided with a sufficient amount of fluid by the forepump. In this way, a particularly good efficiency of the main pump and consequently a good efficiency of the fluid delivery device are achieved.

A further embodiment of the invention provides that the main pump has a main pump drive gear and a main pump delivery gear interacting with the forepump delivery gear to deliver the fluid, wherein the forepump delivery gear and the main pump drive gear are drivingly connected to the connecting shaft. To that extent, what has been said for the forepump drive gear and forepump delivery gear preferably applies to the main pump drive gear and the main pump delivery gear. The main pump drive gear also interacts with the main pump delivery gear to deliver the fluid, for example by engaging or meshing with one another. In the case of the configuration of the main pump as a gear pump, the main pump drive gear can be referred to as the main pump drive gear wheel and the main pump delivery gear as the main pump delivery gear wheel.

The main pump drive gear is drivingly coupled to the main pump input shaft, preferably in a fixed and/or permanent manner. For example, the main pump drive gear sits on the main pump input shaft, so that when the fluid delivery device is operating, the speed of the main pump drive gear corresponds to the speed of the main pump input shaft. The main pump drive gear and the main pump delivery gear cooperate to deliver the fluid in such a way that the main pump delivery gear is driven by the main pump drive gear during the operation of the fluid delivery device. When the main pump drive gear rotates, there is also a rotary movement of the main pump delivery gear, so that the fluid delivery effect is achieved overall.

For the drive coupling of the main pump to the forepump, the forepump delivery gear and the main pump drive gear are drivingly connected to the connecting shaft, namely preferably in a fixed and/or permanent manner. For this purpose, it is provided, for example, that the connecting shaft is formed integrally with the main pump input shaft or forms it. Both the forepump delivery gear and the main pump drive gear are preferably arranged on the connecting shaft and drivingly connected to it. For example, the forepump delivery gear and the main pump drive gear are rotatably supported via the connecting shaft. This avoids additional storage of the forepump delivery gear or the main pump drive gear, so that the installation space requirement of the fluid delivery device is further reduced.

A preferred embodiment of the invention provides that the main pump is in the form of an internal gear pump, in particular a sickle pump, the main pump drive gear being designed as a pinion gear and the main pump delivery gear being designed as a ring gear. The internal gear pump is particularly preferably designed to be gap-compensated. The internal gear pump can be designed without a filler or with a filler. In the latter case, it is in the form of the sickle pump, in which the (sickle-shaped) filler is arranged between the pinion gear and the ring gear, so that the filler—seen in cross section with respect to an axis of rotation of the pinion gear and/or an axis of rotation of the main pump delivery gear—abuts radially with an inward inner side on the pinion gear, in particular on teeth of the pinion gear, and abuts radially with its outer side on the ring gear, in particular on teeth of the ring gear. The design of the main pump as an internal gear pump allows a particularly high efficiency of the fluid delivery device.

A further preferred embodiment of the invention provides that a further transmission gear is arranged in the operative connection between the forepump delivery gear and the main pump input shaft. The further transmission gear thus joins the transmission gear formed by the forepump drive gear and the forepump delivery gear, so that the main pump is connected to the drive shaft via the transmission gear and the further transmission gear, which are connected in series with one another. The further transmission gear is present, for example, as a gear transmission, for example as a spur gear transmission. In particular, it is designed as an epicyclic gear and/or planetary gear.

The further transmission gear has a transmission ratio which is preferably different from one, so that between the speed of the main pump input shaft and the speed of the forepump delivery gear there is a certain speed ratio which corresponds to the transmission ratio of the further transmission gear. In the case of the transmission ratio of the further transmission gear, which is different from one, the speeds of the forepump delivery gear and main pump input shaft are different from one another during operation of the fluid delivery device. The use of the further transmission gear allows operation of both the forepump and the main pump at an optimal speed in each case.

Another embodiment of the invention provides that the forepump has a forepump fluid inlet and a forepump fluid outlet and the main pump has a main pump fluid inlet and a main pump fluid outlet, wherein a delivery device fluid inlet of the fluid delivery device is fluidically connected to the forepump fluid inlet, the forepump fluid outlet is fluidically connected to the main pump fluid inlet, and the main pump fluid outlet is fluidically connected to the delivery device fluid outlet of the delivery device. The fluid delivery device itself thus has the delivery device fluid inlet and the delivery device fluid outlet. The fluid is made available to the fluid delivery device via the delivery device fluid inlet and provides the fluid delivered by means of the forepump and the main pump via the delivery device fluid outlet. In other words, fluid is supplied to the fluid delivery device via the delivery device fluid inlet and fluid is withdrawn via the delivery device fluid outlet.

The forepump has the forepump fluid inlet and the forepump fluid outlet. Fluid is made available to the forepump via the forepump fluid inlet and the fluid delivered by means of the forepump is removed via the forepump fluid outlet. The same applies to the main pump, which has the main pump fluid inlet and the main pump fluid outlet. The main pump is provided with the fluid via the main pump fluid outlet, which is drawn through the main pump fluid outlet after being conveyed by the main pump.

The forepump and the main pump are fluidically connected in series. For this purpose, the forepump fluid inlet is fluidically connected to the delivery device fluid inlet, so that the forepump is supplied directly with the fluid which is fed to the fluid delivery device. The forepump fluid outlet is connected to the main pump inlet, so that the main pump is supplied with fluid delivered by the forepump. The main pump fluid outlet is in turn fluidically connected to the delivery device fluid outlet, so that the fluid delivered by means of the forepump and the main pump can be removed or is removed via the delivery device fluid outlet of the fluid delivery device.

A further development of the invention provides that the forepump fluid outlet is fluidically connected to the forepump fluid inlet via a bypass line having a valve arrangement, in particular a check valve. A direct flow connection between the forepump fluid inlet and the forepump fluid outlet can be established via the bypass line, which does not run via the forepump itself. To this extent, fluid can flow back from the forepump fluid outlet to the forepump fluid inlet bypassing the forepump via the bypass line. The valve arrangement, by means of which the flow connection can be set, is arranged in the bypass line. For example, in a first setting of the valve arrangement, the flow connection between the forepump fluid outlet and the forepump fluid inlet via the bypass line is interrupted, whereas it is established in a second setting.

The valve arrangement is particularly preferably in the form of the check valve or at least has one. This is designed in such a way that it allows a flow from the forepump fluid outlet to the forepump fluid inlet, but prevents a flow in the opposite direction. For example, the check valve is designed such that it only establishes the flow connection between the forepump fluid outlet and the forepump fluid inlet in the direction of the forepump fluid inlet when a pressure difference between the forepump fluid outlet and the forepump fluid inlet exceeds a specific pressure difference. With the help of the bypass line and the valve arrangement in it, a supply of fluid to the main pump is ensured as required. In this case, the check valve acts in particular as a pressure relief valve, so that the pressure applied to the main pump on the inlet side and caused by the forepump is limited to a specific value.

The bypass line and the check valve or pressure relief valve serve to supply the main pump with fluid as required. They are particularly necessary if the forepump delivers more fluid in the direction of the main pump in at least one operating state than it can absorb. A configuration is therefore particularly ideal in which the bypass line and the valve arrangement or the check valve are omitted and the forepump is matched to the main pump in such a way that the main pump is always acted upon by the fluid. For this purpose, the forepump of the main pump provides exactly or at least almost exactly the amount of fluid that it can absorb, in particular at an exact speed of the drive shaft, at least one speed of the drive shaft, or a plurality of different speeds of the drive shaft, particularly preferably over a nominal speed range of the drive shaft, which occurs during intended operation of the fluid delivery device or at least can occur.

Finally, it can be provided in the scope of a further preferred embodiment of the invention that the forepump and the main pump are arranged in a common pump housing. The two pumps, that is to say the forepump and the main pump, are therefore not present in different housings, but rather are integrated in the fluid delivery device. In particular, both the forepump drive gear and the forepump delivery gear of the forepump as well as the main pump drive gear and the main pump delivery gear of the main pump are rotatably mounted in or on the common pump housing. This results in a particularly compact design of the fluid delivery device.

Figure 2:
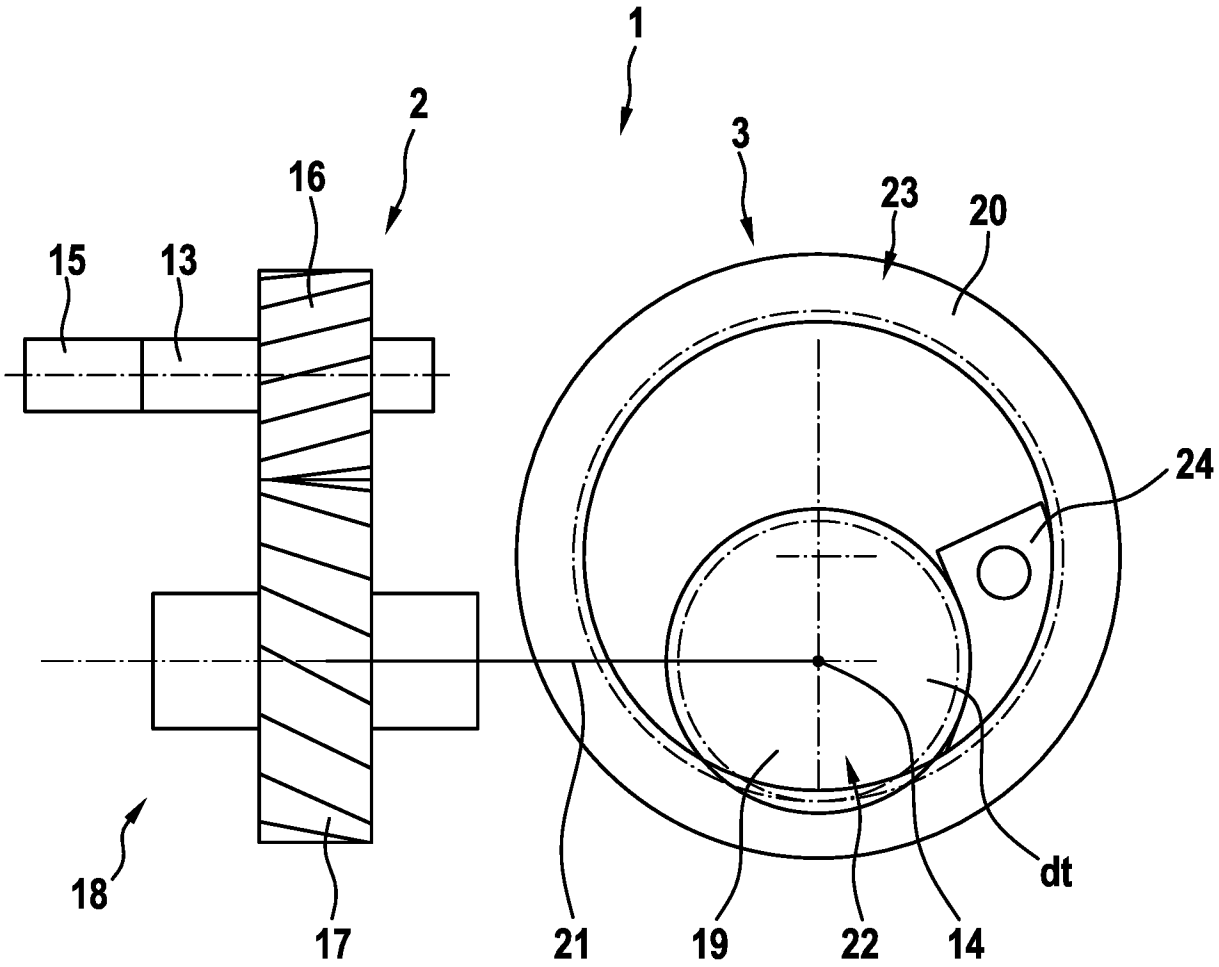
Figure 3:
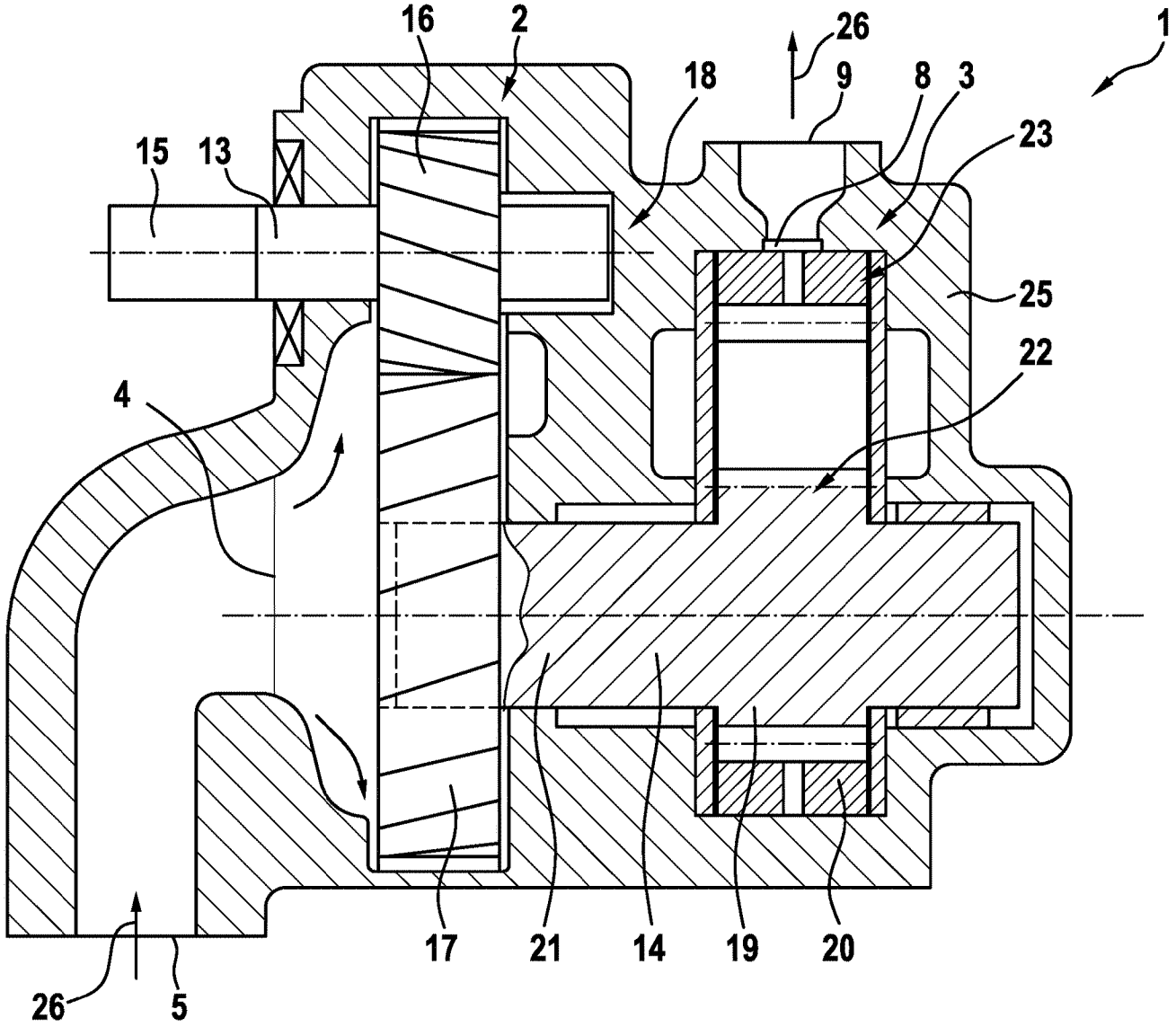

The invention is explained in more detail below with reference to the exemplary embodiments shown in the drawing, without the invention being restricted. In the drawings:

FIG. 1 is a schematic illustration of a fluid delivery device having a forepump and a main pump, FIG. 2 is a schematic illustration of the fluid delivery device in a second view, and FIG. 3 is a schematic sectional view through the fluid delivery device, wherein the forepump and the main pump are present in a common pump housing.

FIG. 1 shows a schematic illustration of a fluid delivery device 1 which has a forepump 2 and a main pump 3. The forepump 2 has a forepump fluid inlet 4, which is fluidically connected to a delivery device fluid inlet 5. A forepump fluid outlet 6 of the forepump 2 is fluidically connected to a main pump fluid inlet 7. A main pump fluid outlet 8 of the main pump 3 is in turn fluidically connected to a delivery device fluid outlet 9 of the fluid delivery device 1. In the end, the forepump 2 and the main pump 3 are fluidically connected in series between the delivery device fluid inlet 5 and the delivery device fluid outlet 9. It can be seen that the forepump fluid outlet 6 and the forepump fluid inlet 4 are fluidically connected to one another via a bypass line 10. A valve arrangement 11 is provided in the bypass line 10, which has a check valve 12 or is designed as such.

The forepump 2 can be driven via a forepump input shaft 13 and the main pump 3 via a main pump input shaft 14. The forepump 2 and the main pump 3 are drivingly connected to a common drive shaft 15. In other words, the forepump input shaft 13 and the main pump input shaft 14 are both drivingly connected to the drive shaft 15. In the case of the forepump input shaft 13, there is a direct connection. For example, the forepump input shaft 13 is formed in one piece with the drive shaft 15. The main pump input shaft 14, on the other hand, is drivingly connected to the drive shaft 15 via the forepump 2. For this purpose, a forepump drive gear 16 and a forepump delivery gear 17 of the forepump 2 form a transmission gear 18 for the main pump 3.

The forepump drive gear 16 is coupled to the forepump input shaft 13, preferably it sits on it and is connected to it in a fixed and/or permanent manner. The forepump delivery gear 17, on the other hand, is driven by the forepump drive gear 16 during operation of the fluid delivery device 1, that is to say when the drive shaft 15 rotates. In the exemplary embodiment shown here, the forepump 2 is in the form of a gear pump, namely an external gear pump. The forepump drive gear 16 and the forepump delivery gear 17 are in this respect in the form of gears which mesh with one another to form the transmission gear 18. In addition, the forepump drive gear 16 and the forepump delivery gear 17 cooperate to deliver the fluid.

Analogously to this, the main pump 3 has a main pump drive gear 19 and a main pump delivery gear 20. These also work together to provide a fluid delivery effect of the main pump 3. To drivingly connect the main pump 3 to the forepump 2, a connecting shaft 21 is provided which connects the forepump delivery gear 17 and the main pump input shaft 14 and thus the main pump drive gear 19 to one another. In this respect, it is clear that the forepump input shaft 13 is coupled directly to the drive shaft 15, whereas the main pump input shaft 14 is only indirectly drivingly coupled to the drive shaft 15 via the connecting shaft 21 and the forepump 2, i.e. is driven by the drive shaft 15 via the forepump 2.

An embodiment of the fluid delivery device 1 is particularly advantageous, in which both the forepump 2 and the main pump 3 are designed as gear pumps. In the embodiment shown here, the forepump 2 is in the form of an external gear pump and the main pump 3 is in the form of an internal gear pump. Here, the main pump drive gear 19 is a pinion gear 22 and the main pump delivery gear 20 is a ring gear 23 of the internal gear pump. The pinion gear 22 and the ring gear 23 are rotatably mounted about mutually offset axes of rotation. When viewed in cross section, the pinion gear 22 has outer dimensions that are smaller than inner dimensions of the ring gear 23, so that only part of a toothing of the pinion gear 22 meshes with the toothing of the ring gear 23. The internal gear pump is designed as a sickle pump, so that a sickle-shaped filler piece 24 is arranged in regions between the pinion gear 22 and the ring gear 23. Either the forepump 2 or the main pump 3 are preferably designed to be gap-compensated. In particular, an embodiment is preferred in which the main pump 3, but not the forepump 2, is gap-compensated. The forepump 2 is so far without gap compensation. However, both the forepump 2 and the main pump 3 can also be gap-compensated.

FIG. 2 shows a further schematic illustration of the fluid delivery device 1. It can be seen that the forepump 2 or the forepump drive gear 16 and the forepump delivery gear 17 each have helical teeth. As a result, the smooth running of the forepump 2 is significantly improved. With regard to the further configuration of the fluid delivery device 1, reference is made to the above statements.

FIG. 3 shows a further schematic illustration of the fluid delivery device 1. Again, reference is made in full to the above statements. In addition, it is now clear that the forepump 2 and the main pump 3 are arranged in a common pump housing 25. Here, the forepump drive gear 16, the forepump delivery gear 17, the main pump drive gear 19 and the main pump delivery gear 20 are preferably rotatably mounted in and/or on the pump housing 25. A direction of flow of the fluid through the fluid delivery device 1 is indicated by the arrows 26.

The fluid delivery device 1 shown here has excellent delivery properties for the fluid with a long service life because the forepump 2 and the main pump 3 are ideally matched to one another, namely by means of the transmission gear 18.

As shown in FIG. 1, a further transmission gear 28 may be arranged in operative connection between the forepump delivery gear 17 and the main pump input shaft 14.

The invention claimed is:

1. A fluid delivery device having:

a forepump and a main pump fluidically connected to the forepump, wherein the forepump is driven via a forepump input shaft and the main pump is driven via a main pump input shaft, wherein the forepump has a forepump fluid inlet and a forepump fluid outlet; the main pump has a main pump fluid inlet and a main pump fluid outlet, wherein a delivery device fluid inlet of the fluid delivery device is fluidically connected to the forepump fluid inlet, the forepump fluid outlet is fluidically connected to the main pump fluid inlet, and the main pump fluid outlet is fluidically connected to the delivery device fluid outlet of the fluid delivery device, wherein the forepump has a forepump drive gear coupled to the forepump input shaft and a forepump delivery gear interacting with the forepump drive gear to deliver the fluid, wherein the forepump and the main pump are drivingly coupled to a common drive shaft, and wherein the forepump delivery gear and the main pump input shaft are connected to one another via a connecting shaft such that the forepump input shaft is coupled directly to the drive shaft and the main pump input shaft is coupled to the drive shaft via the connecting shaft, wherein the forepump fluid outlet is fluidically connected to the forepump fluid inlet via a bypass line having a check valve, and the forepump has a larger delivery volume than the main pump.

2. The fluid delivery device according to claim 1, wherein the forepump drive gear and the forepump delivery gear form a transmission gear for the main pump having a specific transmission ratio.

3. The fluid delivery device according to claim 1, wherein the forepump is a gear pump and/or the main pump is designed as a rotary piston pump.

4. The fluid delivery device according to claim 1, wherein the main pump has a main pump drive gear and a main pump delivery gear interacting with the main pump drive gear to deliver the fluid, wherein the forepump delivery gear and the main pump drive gear are drivingly connected to the connecting shaft.

5. The fluid delivery device according to claim 1, wherein the main pump is an internal gear pump, wherein the main pump drive gear is a pinion gear and the main pump delivery gear is a ring gear.

6. The fluid delivery device according to claim 1, wherein a further transmission gear is arranged in the operative connection between the forepump delivery gear and the main pump input shaft.

7. The fluid delivery device according to claim 1, wherein the forepump and the main pump are arranged in a common pump housing.

8. The fluid delivery device according to claim 1, wherein the main pump is a sickle pump.

* * * * *